United States Patent [19]

Read

[11] Patent Number: 4,830,222

[45] Date of Patent: May 16, 1989

[54] COMBINATION SPOON AND FOOD CONTAINER

[76] Inventor: Avis O. Read, 6702 E. McDonald Dr., Scottsdale, Ariz. 85253

[21] Appl. No.: 54,322

[22] Filed: May 26, 1987

Related U.S. Application Data

[63] Continuation of Ser. No. 823,256, Jan. 28, 1986, abandoned.

[51] Int. Cl.[4] ..... B65D 35/18

[52] U.S. Cl. ..... 222/106; 30/123.3; 426/115

[58] Field of Search ..... 222/106, 92, 205, 206, 222/101, 103, 107; 30/123.3, 125, 141; 426/115

[56] References Cited

U.S. PATENT DOCUMENTS

| | | | |
|---|---|---|---|
| 1,000,178 | 8/1911 | Kahl | 30/123.3 |
| 2,634,886 | 4/1953 | Land | 222/107 |
| 2,862,496 | 12/1958 | Hassler et al. | 222/103 |
| 3,116,152 | 12/1963 | Smith | 426/115 |
| 3,154,418 | 10/1964 | Lovell et al. | 426/115 |
| 4,270,672 | 6/1981 | Kraals | 222/103 |

*Primary Examiner*—Joseph J. Rolla
*Assistant Examiner*—Kenneth Noland
*Attorney, Agent, or Firm*—LaValle D. Ptak

[57] ABSTRACT

A disposable combined container and feeding spoon, particularly useful for storing and feeding baby food, includes a collapsible envelope of relatively thin flexible plastic for holding the food. The envelope is bonded to the elongated handle of a spoon, and a narrow severable projection of the envelope extends over the bowl of the spoon. When the projection is severed, food may be squeezed out of the envelope by pressing the envelope against the handle to force controlled quantities of the food onto the bowl of the spoon to permit feeding of persons such as babies therefrom.

6 Claims, 1 Drawing Sheet

FIG. 1
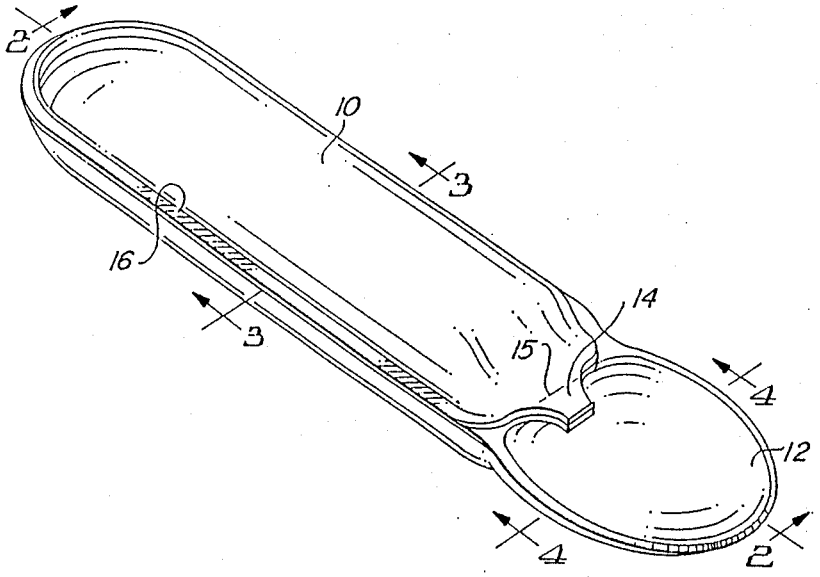
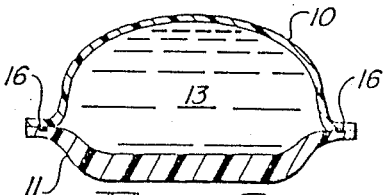
FIG. 3
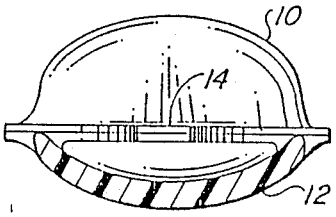
FIG. 4
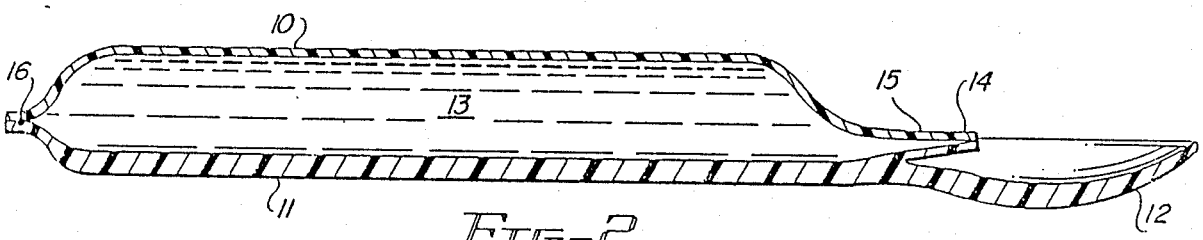
FIG. 2
FIG. 5
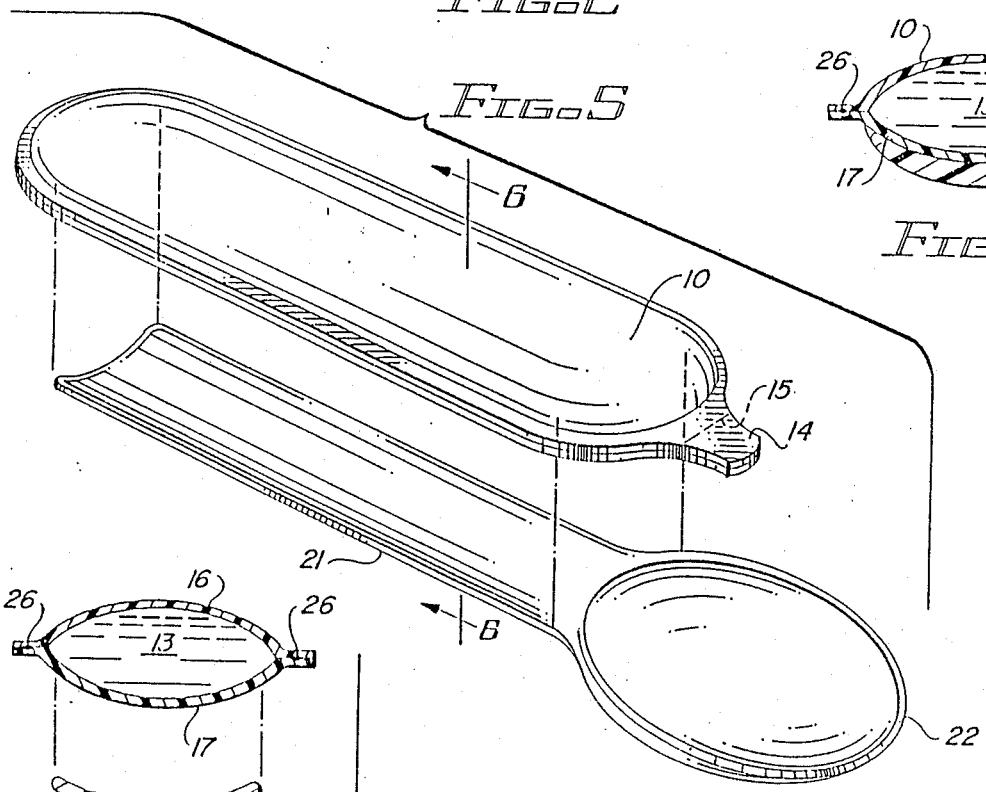
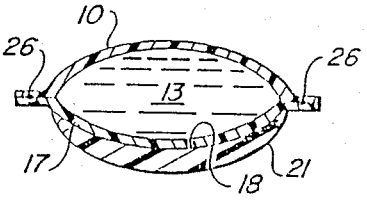
FIG. 7
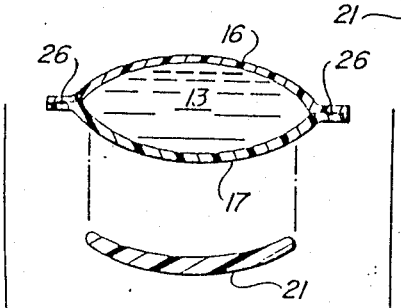
FIG. 6

COMBINATION SPOON AND FOOD CONTAINER

This is a continuation of application Ser. No. 06/823,256, filed Jan. 28, 1986 now abandoned.

BACKGROUND

Containers for food are manufactured in a wide variety of shapes and sizes and out of a wide variety of different materials. Among such packages are the "tin" cans widely used for selling food in grocery stores. One of the disadvantageous of packaging food in such cans, however, is that special can openers or tear strips must be provided to open the cans; and once the cans are open, they cannot be resealed. Another popular package for food is a glass bottle with a removable lid. An advantage of this type of container is that the container can be resealed after use for storing unused portions of the food for use at some subsequent time.

Also in widespread use are various types of metal foil packages and plastic bags, primarily for frozen foods which are prepared by placing the packages in an oven, microwave oven or boiling water, to cook the food.

Another package usually used for condiments in fast food restaurants is a relatively small plastic envelope having a tear strip across a corner or one end for opening the package. The contents then are squeezed out through the opening to dispense the contents where desired. Packages of this type generally are used to dispense relatively small amounts of condiments such as ketchup, mustard, relish and the like.

In the marketing of baby food, most baby foods for the "infant" and "junior" categories are packaged in glass bottles with removable lids. Several disadvantageous are inherent in such packaging. First of all, the contents, even of the jars used for small babies, usually are more than can be consumed by an infant at any one meal. In addition, the jars containing vegetables and meats must be heated in hot water to bring the contents up to a warm temperature for feeding. There is always a danger of overheating the food. This, at the very least, can result in discomfort to the child and possibly can result in burns if a mother forgets to check the temperature prior to feeding. Since the food is in a glass bottle container, it must be removed from the container for feeding, and a mother generally does this by using a spoon. In most cases, the mother holds the baby food jar in one hand and weilds the spoon in the other hand. Most mothers also need a "third" hand to help keep the baby from knocking the spoon away from its mouth during the feeding process. If the jar is placed on a feeding table; so that the mother may then use one of her hands to help control the child's arms, frequently the child manages to strike the jar and knock it over spilling the contents on the floor. Any mother who has had to contend with the feeding of an active infant is well aware of the many disadvantages inherent with the baby food jar packages currently used.

Efforts have been made in the past to provide a composite container and combination feeding implement (such as a spoon) in an effort to overcome some of the foregoing disadvantages, particularly with respect to baby food. One such attempt at combining a baby food container and spoon is illustrated in the patent to Smith U.S. Pat. No. 3,116,152. The Smith patent has the food prepackaged in a collapsible tube (such as a toothpaste type of tube) with a tip of the tube extended over the base of an integrally formed spoon. When the food is to be consumed, the tip is cut off with a knife and the tube is squeezed to eject food onto the spoon portion. The spoon portion is a relatively short spoon bowl at the dispensing end of the tube. The remainder of the tube is of a soft pliable plastic, so that it can be squeezed or rolled up to dispense the food onto the bowl. Once a substantial quantity of food has been squeezed out of the tube, the collapsible nature of the food container portion of the implement inherently causes it to loose rigidity, and only the bowl portion of the container/spoon remains rigid. As a consequence, the mother must hold the spoon at a point very close to the baby's mouth; and the likelihood of food getting smeared on the hand of the mother during feeding is quite high.

Other combined containers and feeding spoons in which the spoon portion is attached to the dispensing end of a collapsible container portion are disclosed in the patents to Edmonds U.S. Pat. No. 2,252,119; Hansen U.S. Pat. No. 3,104,032; Wille U.S. Pat. No. 2,837,822; Bush U.S. Pat. No. 2,953,170; Grimsley U.S. Pat. No. 3,383,018; and Brown U.S. Pat. No. 3,133,679. All of these patents disclose a short spoon, comprising at least a bowl portion, which is screwed onto the cap of a collapsible container having an opening for ejecting non-solid food in the form of food paste or liquid from the container onto the bowl of the spoon. Most of the containers disclosed in these patents are rigid or semi-rigid, but all of the structures are relatively expensive multiple-piece structures. The devices of these patents do not readily lend themselves to an inexpensive throw-away or disposable container.

Three patents which are directed to combinations of nipples and collapsible containers for feeding babies are the patents to Emerson et al, U.S. Pat. No. 3,523,026; Barton U.S. Pat. No. 2,876,113; and Swanson et al, U.S. Pat. No. 3,143,429. The Emerson patent is directed to a nursing package comprising an outer framework in which a collapsible bag is suspended with a nipple connected over the end. Food is not packaged for sale in the bags, but they are filled for use by the mother. This structure is widely used today for feeding milk or formula to small babies.

The Barton patent also discloses a nipple and collapsible tube feeder. It has some of the features of the Emerson et al patent, but food concentrate is sealed into an intermediate portion of the container for sale of the unit as a package along with the nipple. When the device is to be used, a foil seal is opened to expose the food concentrate. The concentrate then is poured into the collapsible bag in the bottle and an appropriate amount of liquid is added. The food then is dispensed through the nipple and the bag automatically collapses.

Swanson is generally similar to Barton and Emerson and is directed to a collapsible disposable container and nursing unit in which the food is pre-packaged in the collapsible container for subsequent use. Swanson also mentions use of the dispenser for condiments or for use in space travel and other related uses.

It is desirable to provide a combination disposable container and feeding spoon, particularly suitable for dispensing baby food, which is not subject to the disadvantages of the above mentioned prior art. Such a container/spoon combination also should be easy to use and inexpensive to manufacture.

SUMMARY OF THE INVENTION

In accordance with a preferred embodiment of this invention, a combined disposable container and feeding spoon device includes a collapsible envelope portion for containing a predetermined quantity of non-solid food. A substantially rigid spoon portion has a bowl and an elongated handle which extends substantially the length of the collapsible envelope. This handle is bonded to the envelope portion to form the composite package. The bowl of the spoon is adjacent a severable projection in an end of the collapsible envelope, and the handle portion of the spoon underlies the envelope to provide rigidity to the combined assembly. When the severable projection is opened, the food in the envelope may be squeezed out through the projection onto the bowl of the spoon in controlled quantities.

BRIEF DESCRIPTION OF THE DRAWING

FIG. 1 is a perspective view of a preferred embodiment of the invention;

FIG. 2 is a cross-sectional view taken along the line 2—2 of FIG. 1;

FIG. 3 is a cross-sectional view taken along the line 3—3 of FIG. 1;

FIG. 4 is a cross-sectional view taken along the line 4—4 of FIG. 1;

FIG. 5 illustrates another embodiment of the invention;

FIG. 6 is a cross-section taken along the line 6—6 of FIG. 5; and

FIG. 7 is a cross-sectional view of an assembly of the type shown in FIGS. 5 and 6.

DETAILED DESCRIPTION

Reference now should be made to the drawing in which the same or similar components have the same reference numbers throughout the different figures. FIGS. 1 through 4 illustrate a preferred embodiment of the invention. As shown, a disposable combination container and feeding spoon comprises a plastic spoon portion having a bowl 12 and a handle 11. The handle is almost as wide as the bowl portion 12 and is approximately 4 or 5 inches long. The handle 11 is somewhat "boat-shaped" as is seen most clearly in the cross-sectional view of FIG. 3. This forms a depression in it along its length. As shown in FIG. 2, the rear end of the handle is up-turned to form a lip all around the edges of the handle.

For baby food, a single serving portion of food 13 for a baby or infant then is contained on the handle 11 by providing a polyvinyl chloride envelope 10 over the top of the handle. This envelope is bonded to the handle 11 along the sides and rear by means of heat bonding or other suitable bonding 16, as illustrated in FIGS. 1, 2 and 3. The forward end of the envelope 10 terminates in a severable projection 14 provided with a cutting or tear line 15 as shown most clearly in FIGS. 1 and 2. This projection 14 extends out over the bowl 12 of the spoon.

Appropriate liquid or other non-solid or paste food 13 is placed in the container formed by the envelope 10 and the handle 11 prior to the final bonding of the rear of the handle 11 to the envelope material 10. The manner in which this packaging is accomplished is comparable to the manner used to package condiments in polyvinyl chloride envelopes, except that the handle 11 provides substantial longitudinal rigidity to the completed package which is not present in conventional plastic envelope food packaging.

To use the container/spoon combination of the embodiment shown in FIGS. 1 to 4 for the purpose of feeding a baby or an invalid, the food may be warmed directly through the body heat of the mother or person serving the food by pressing the envelope side 10 of the combined package against the body. This quickly brings the food up to normal body temperature for feeding purposes. Obviously, the conatiner could also be placed in hot water to accomplish the same purpose.

After the food has been heated, by whatever method is selected, the projection 14 is severed along the cutting line 15. A squeezing pressure on the flexible plastic envelope 10 to press it toward the rigid spoon handle 11 forces controlled quantities of food 13 out of the envelope onto the bowl 12 of the spoon. The food is delivered directly into the bowl as is apparent from an examination of FIG. 2, which illustrates the manner in which the projection 14 extends out over the rear portion of the bowl 12. When the desired quantity of food is deposited in the bowl 12, the device then is used in the manner of a conventional spoon to deliver the food to the mouth of the infant or other person being fed. This process is repeated until the contents of the envelope 10 are exhausted. Because of the "boat-shaped" or concave cross section of the handle portion 11 of the spoon, minimum waste occurs since the food may be moved from the left-hand end of the handle 11 (as illustrated in FIGS. 1 and 2) by pressing the thumb or fingers downwardly on the envelope 10 against the depression in the handle 11 to force the food forward to the exit end at the cutting line 15 in the projection 14. When the envelope 10 is nearly empty, several moves of this type will serve to completely exhaust the food from the envelope and deliver it to the bowl 12 of the spoon.

FIGS. 5, 6 and 7 illustrate another embodiment of the invention. In this embodiment, the food containing envelope 10 is constructed and filled prior to bonding it to the handle 21 of the spoon which, in FIGS. 5, 6 and 7, is shown as also having a bowl 22. As illustrated most clearly in FIG. 6, the envelope comprises upper and lower sheets 10 and 17 which are bonded around the edges at a bond line 26. The forward end of the envelope continues to have the severable projection 14 which may be cut or torn at the line 15 in the same manner described above in the embodiment FIGS. 1 through 4.

After the envelope 10/17 has been filled with food 13, it then is bonded in a suitable manner to the convex side of the curved handle 21 as illustrated in FIGS. 5 and 7. The package then is an integral package, and the food container 10/17 cannot be separated from the handle 21 of the spoon. Delivery of food and the manner of use of the embodiment shown in FIGS. 5, 6 and 7 is the same as that described above for the embodiment of that of FIGS. 1 through 4.

All of the components of the embodiments which have been described above and which are shown in the drawings may be made of plastic and the entire assembly may be packaged for purposes of storage in a sterilized, clear plastic package or the like. Polyvinyl chloride (PVC) may be used for both the spoon 11/12 or 21/22 and the envelope 10/17. For the envelope, a thickness of 0.0020 inches provides sufficient strength with considerable flexibility. The spoon is provided with sufficient thickness to give it the structural rigidity necessary for convenient handling, particularly when the food 13 is exhausted or nearly exhausted from the envelope in either of the embodiments. A particular advantage of the two embodiments which have been described is that even when the food is nearly all exhausted, the handles 11 or 21 of the spoons provide normal rigidity for handling in a normal manner.

The foregoing embodiments have been shown and described as illustrative only of the invention and are not to be considered as limiting. Various changes and modifications will occur to those skilled in the art without departing from the scope of the invention. For example, different materials, other than polyvinyl chloride, maybe used. The dimensions which have been given are considered desirable, but may be varied to achieve different aesthetic appearances or for other reasons. Such changes, and others which will occur to those skilled in the art, can be made without departing from the scope of the invention as claimed.

I claim:

1. A disposable combined container and feeding spoon including in combination:

an envelope portion made of flexible material having a predetermined width and a predetermined length; and a substantially rigid spoon portion with a bowl interconnected to a rigid elongated handle therewith, the cross-sections of said handle across the width thereof being upwardly facing, substantially concave cross-sections, with said handle underlying the width and length of said envelope portion and attached to said envelope portion to hold said envelope portion in position on said handle, said envelope portion and said handle forming thereby a container for containing a predetermined quantity of non-solid food, with a narrow, severable projection positioned at one end of the envelope portion and the handle, said projection formed by an extension of the envelope portion and a severable portion attached to the handle, with said bowl located adjacent said projection such that depression of said flexible envelope portion toward said handle and from the end thereof remote from said bowl toward said bowl forces the contents of said container through said severable projection onto said bowl in controlled quantities subsequent to severance of said severable projection.

2. The combination according to claim 1 wherein said predetermined width is less than said predetermined length.

3. The combination according to claim 2 wherein said projection overlies a portion of said bowl of said spoon portion.

4. The combination according to claim 1 wherein said handle has edges and an end and said collapsible envelope portion comprises a sheet of material bonded to the edges and end of said handle of said spoon portion.

5. The combination according to claim 1 wherein said collapsible envelope portion is sealed around the edges thereof and is bonded to said handle of said spoon portion.

6. The combination according to claim 1 wherein said projection overlies a portion of said bowl of said spoon portion.

* * * * *